US005575427A

United States Patent [19]

Karpisek

[11] Patent Number: 5,575,427

[45] Date of Patent: Nov. 19, 1996

[54] BULK PRODUCT HANDLING METHOD AND APPARATUS

[76] Inventor: Ladislav S. Karpisek, 86 Woodfield Boulevarde, Caringbah, New South Wales 2229, Australia

[21] Appl. No.: 325,230

[22] PCT Filed: Feb. 23, 1994

[86] PCT No.: PCT/AU94/00079

§ 371 Date: Oct. 21, 1994

§ 102(e) Date: Oct. 21, 1994

[87] PCT Pub. No.: WO94/19115

PCT Pub. Date: Sep. 1, 1994

[30] Foreign Application Priority Data

Feb. 26, 1993 [AU] Australia ..... PL7530

[51] Int. Cl.[6] ..... B02C 18/06; B02C 19/12

[52] U.S. Cl. ..... 241/30; 241/185.5; 241/200

[58] Field of Search ..... 241/30, 605, 262, 241/186.4, 200, 185.5

[56] References Cited

U.S. PATENT DOCUMENTS

| | | | |
|---|---|---|---|
| 3,208,491 | 9/1965 | Bliss | 241/605 X |
| 3,733,033 | 5/1973 | Cobey | 241/30 |
| 4,034,920 | 7/1977 | Bradley | 241/200 X |
| 4,511,302 | 4/1985 | Moore | 241/200 X |
| 4,961,542 | 10/1990 | Den Besten et al. | 241/200 X |
| 5,025,992 | 6/1991 | Niebur | 241/101.7 |
| 5,033,683 | 7/1991 | Taylor | 241/186.4 X |
| 5,197,684 | 3/1993 | Bihlet et al. | 241/283 |
| 5,217,174 | 6/1993 | Martin et al. | 241/222 |
| 5,282,713 | 2/1994 | Lande | 414/412 |

*Primary Examiner*—John M. Husar
*Attorney, Agent, or Firm*—Paul & Paul

[57] ABSTRACT

A method of converting a mass of berries which have superficially adhered together during storage in a container back to individual berries, said method including the steps of directing the berry mass against an apertured stationary breaking means (9) to randomly disassociate the adhered berries and produce berries and secondary masses of berries able to pass through the apertures, providing a moving breaking means (16) in adjacent relationship to said apertures and repeatedly impacting said secondary masses after passage through said apertures with said moving breaking means to disassociate adhered berries of said secondary masses and thereby reduce the secondary masses to individual berries.

8 Claims, 5 Drawing Sheets

BULK PRODUCT HANDLING METHOD AND APPARATUS

CROSS-REFERENCE TO RELATED APPLICATIONS

This application is based on PCT/AU94/00079 filed Feb. 23, 1994 based on Australian application PL7530 filed Feb. 26, 1993.

BACKGROUND OF THE INVENTION

This invention relates to the handling of quantities of elements which are inherently discrete but prone to consolidate into a mass or a number of masses during bulk storage. Compressible elements with surface characteristics tending to stickiness fall into the above category and a prime example is the dried grape product known as sultanas.

After sultanas are initially processed they are stored in bulk prior to packaging for supermarket and other sales outlets. The storage of sultanas in bulk in a holding container, which is commonly 1.2 meters cube, almost always results in the sultanas consolidating into a mass within the container. The nature of the mass can vary from container to container. In one container the mass may be comprised of a single block of sultanas adhering to each other whilst in other container the mass may be comprised of a number of lumps each made up of many sultanas adhering to each other. Removing the sultanas mass from the container and breaking it up, preferably into individual fruits which will flow readily in the packaging process, whilst causing as little damage as possible to the individual fruits is a major problem in the dried fruit industry.

SUMMARY OF THE INVENTION

The present invention has as its object the alleviation of the above problem.

In broad terms the invention can be said to provide a primary product mass comprised of normally discrete elements which superficially surface adhere to each other when bulk stored to individual elements, said method including the steps of directing the product mass against a stationary breaking means in the form of an apertured area to randomly disassociate the adhered elements comprising said primary mass and thereby product elements and secondary masses the elements of a size able to pass through said apertures, holding the elements and secondary masses after passing through the stationary breaking means in a manner presenting an extended surface of product in adjacent relationship to moving breaking means, and repeatedly impacting the extended surface with said moving breaking means to reduce said secondary masses to individual elements.

The invention further provides and apparatus to carry out a method of converting a primary product mass comprised of normally discrete elements, which superficially surface adhere to each other when bulk stored, to individual elements, the method including the steps of directing the primary product mass against a stationary breaking means to produce elements and secondary masses of the elements of a size able to pass through the stationary breaking means and exposing an extended surface of the product discharged from the stationary breaking means to repeated impact delivered by a moving breaking means to thereby reduce the secondary masses to individual elements, the apparatus including an inclined chute with a bottom and sides and a discharge end stationary breaking means obstructing the free flow of product down said chute and located adjacent said discharge end, a product holding zone in the chute beyond the stationary breaking means where product after passing through the secondary breaking means is presented as an extended surface, a moving breaking means including a conveyor surface with strikers upstanding from said surface to impact against product in the product holding zone.

BRIEF DESCRIPTION OF THE DRAWINGS

A preferred embodiment of the invention will now be described with reference to the accompanying drawings in which.

DESCRIPTION OF THE PREFERRED EMBODIMENTS

Figure 1:
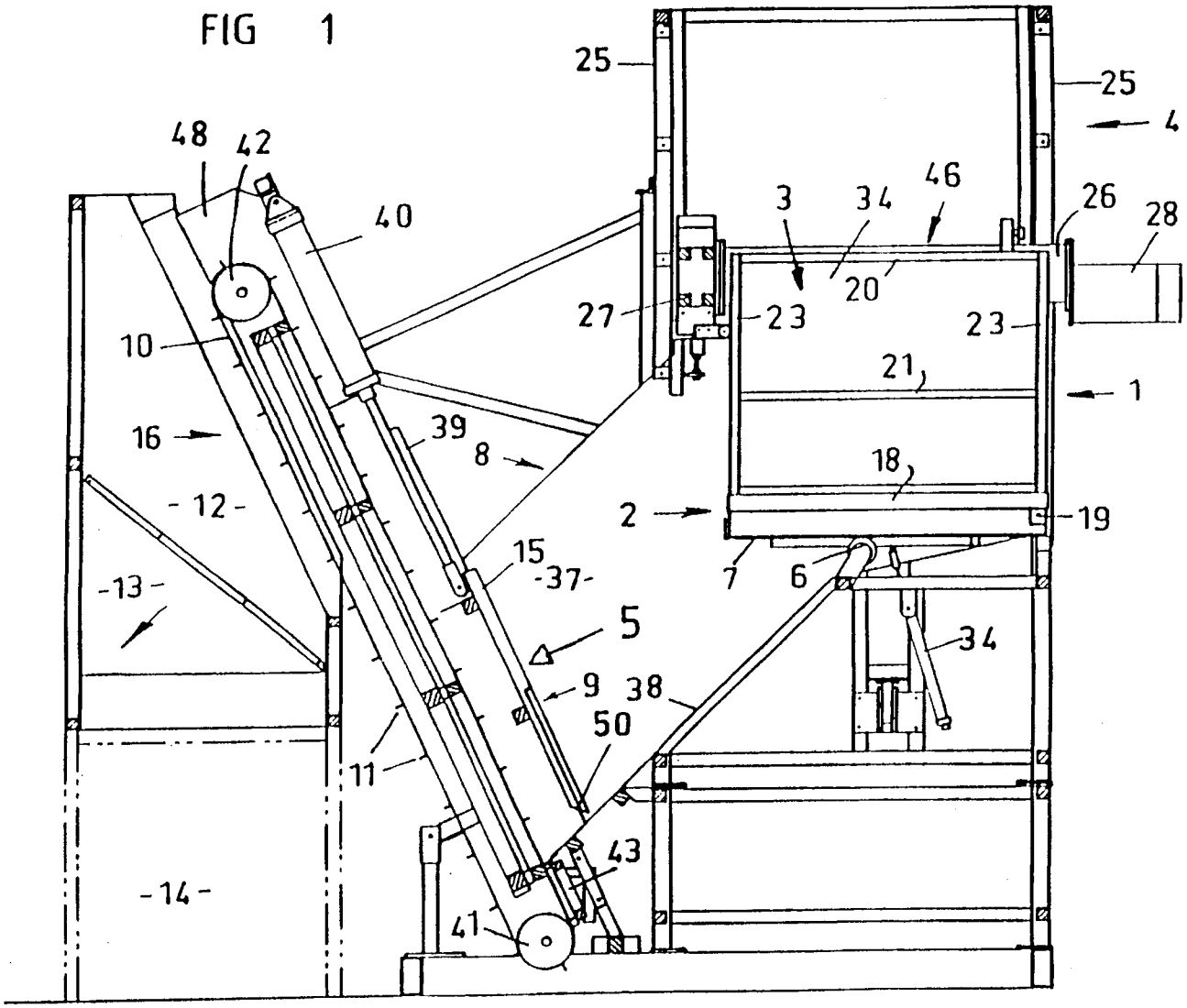
FIG. 1 is a side view in section of the apparatus of the invention with a container in the initial position prior to commencement of a discharge operation and as it would appear when empty and about to be removed from the apparatus.

The apparatus will first be described generally with reference to FIG. 1 and then the preferred detailed construction of the various parts will be given. There is a container 1 with an opening bottom 2 disposed below a four sided enclosure comprised of sides 3. The container is coupled to and is vertically movable relative to a container support frame 4. The bottom 2 of the container is opened by raising the enclosure comprised of the sides 3 relative to a support rollers 6 which bears on a tray 7 on which the bottom 2 rests. The tray 7 is for hygiene reasons and prevents any foreign bodies adhering to the container bottom 2 from falling into the material discharged from the container.

The discharge from the bottom of the container 1 passes down a chute 8 at the discharge end of which there is a stationary mass breaking means 9. The breaking means 9 in its preferred form is a grille comprised of a number of parallel spaced apart bars 15. Reduced size masses pass between the bars 15. The reduction in mass size can result from the discharged mass impacting with the bars 15 which breaks up the impacting mass, the weight of sultanas pressing against the bars 15 to break the engaging mass into smaller size masses which then pass between the bars 15 and from the action of a moving breaking means as described below.

The moving mass breaking means indicated generally 16 includes a conveyor belt 10 with transverse slats 11. The top edges of the slats 11 impact with the reduced size masses passing through the apertures of the stationary mass breaking means 9 and reduce them substantially, desirably to individual berries which rest on the conveyor and are carried away by the slats 11. The conveyor belt 10 discharges into a hopper 12 with a deflector plate 13 adapted by its shape and positioning to distribute the sultanas delivered by the conveyor somewhat evenly onto a conveying means 14 which is associated with the next production stage in the sultana packaging arrangement. The fall from the discharge end of the conveyor onto the inclines plate 13 provides a final separation of any berry clusters which have managed to reach that point in the process.

Having described the apparatus generally, the details of the presently preferred construction illustrated are as follows.

The container 1 comprising the bottom 2 and the sides 3 is preferably of the "knock down" allowing easy and space efficient storage and transport. The sides 3 are corner interlocked and coupled to a base frame 18 to which the container bottom 2 is pivotally connected at 19. Releasable latch means of a suitable type is provided to hold the container bottom 2 closed. The container sides 3 each comprise a frame with an upper rail 20, an intermediate rail 21 and a bottom rail all end connected by vertical posts 23 and the frame carries an inner facing sheet 24, preferably of food grade plastic material.

The support frame 4 includes four uprights 25 which at their upper portions are adapted to act as tracks for a lifting cradle 46 of "U" shape with legs 26 and four lateral connecting base bars 27. Each leg 26 has a container guide element 28 at its leading end to facilitate the placement of a container in the "U" cradle. Each cradle leg 26 houses a lug shaft 29 (see FIG. 4) with lugs (not shown) and by rotation of the shafts 29 the lugs can be moved between a retracted condition where they lie within the legs 26 and an extended position where they project laterally from the legs 26.

The shafts 29 are each provided with a crank arm 30 and they are connected by a link 31. The link 31 is connected to a base bar 27 by a piston-in-cylinder assembly 47 and by moving the piston in the cylinder the link 31 is move, the arms 30 are moved and the shafts 29 are caused to execute a part rotation. In this way the lugs on the shafts 29 can be moved between their retracted and their extended condition.

Figure 2:
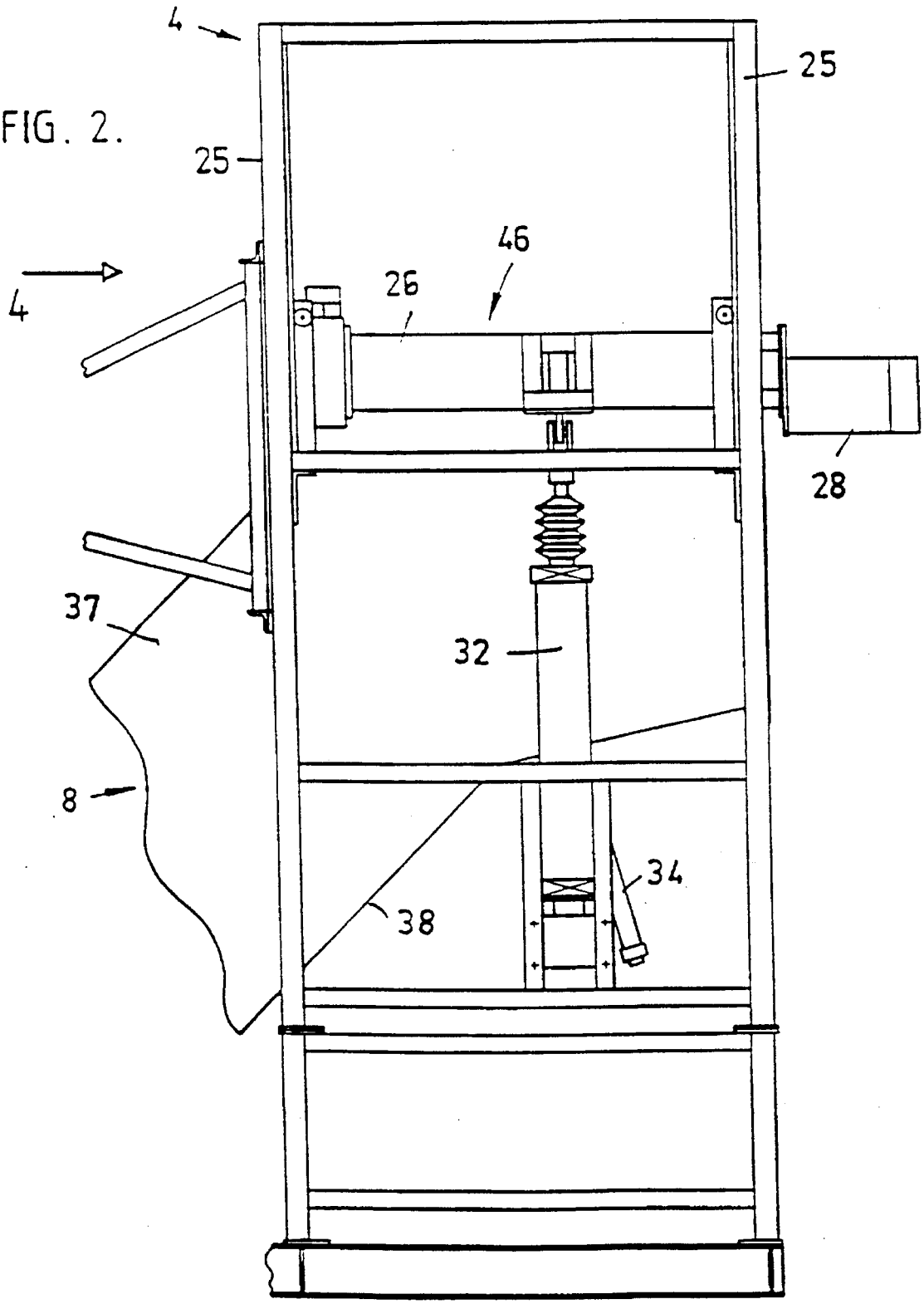
FIG. 2 is an enlarged side view of the container support means of the apparatus without a container mounted therein.
Figure 4:
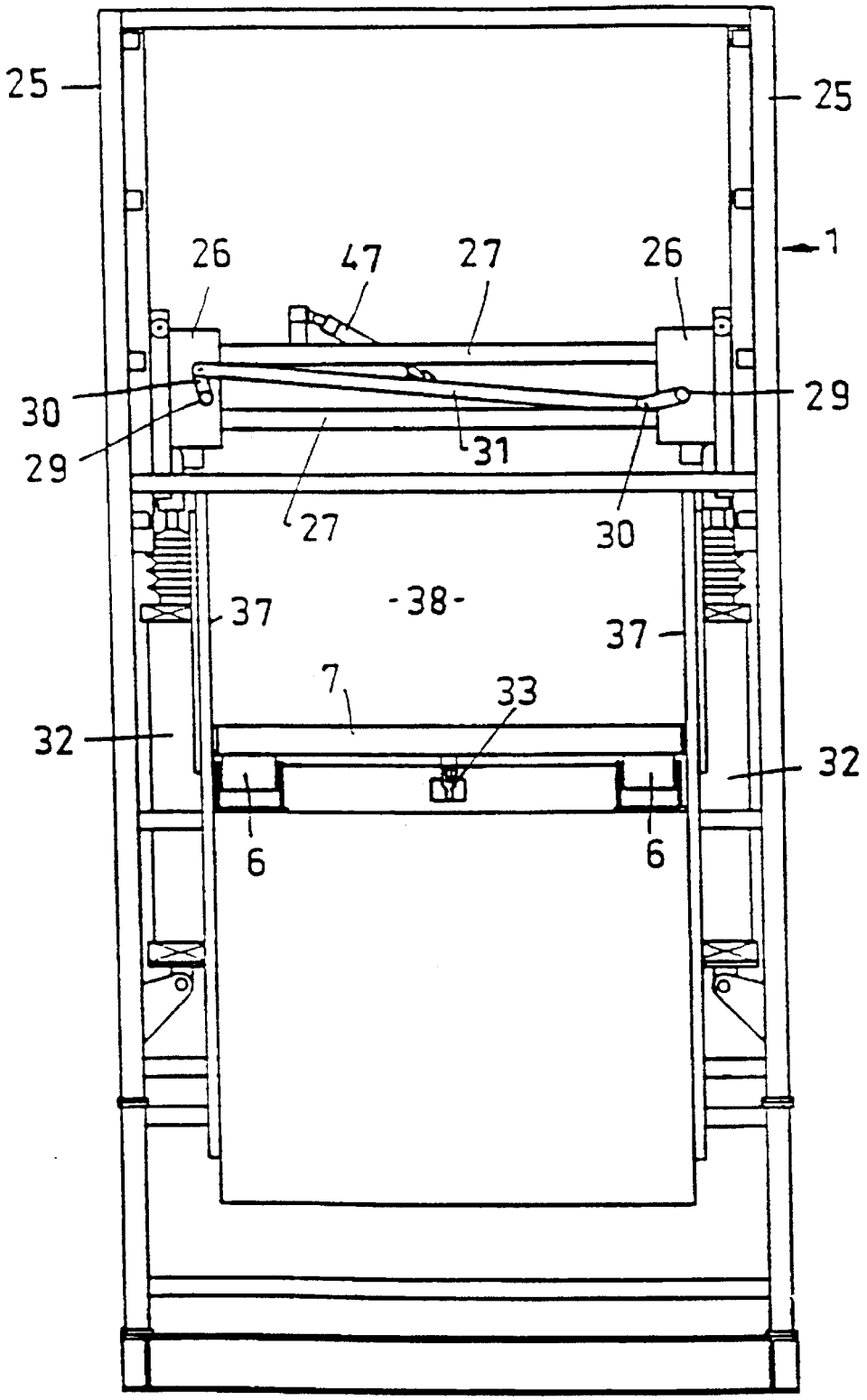
FIG. 4 is a view in the direction of the arrow 4 of FIG. 2
Figure 5:
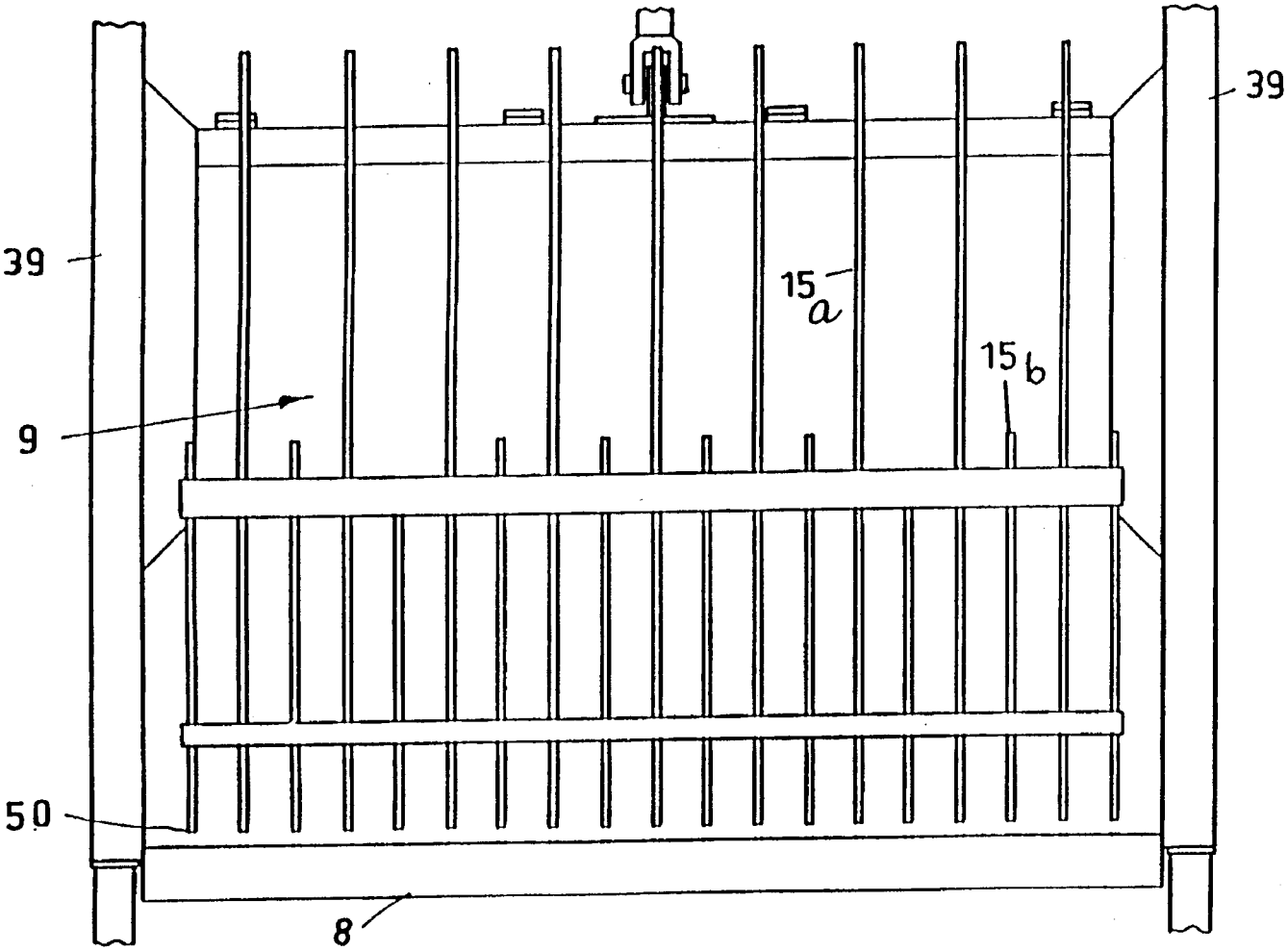
FIG. 5 is an enlarged fragmentary view of the stationary breaking means which is of grille form, in the direction of the arrow 5 of FIG. 1.

As can be seen from FIGS. 2 and 4 the cradle 46 can be raised and lowered by the lifting piston-in-cylinder assemblies 32.

Figure 3:
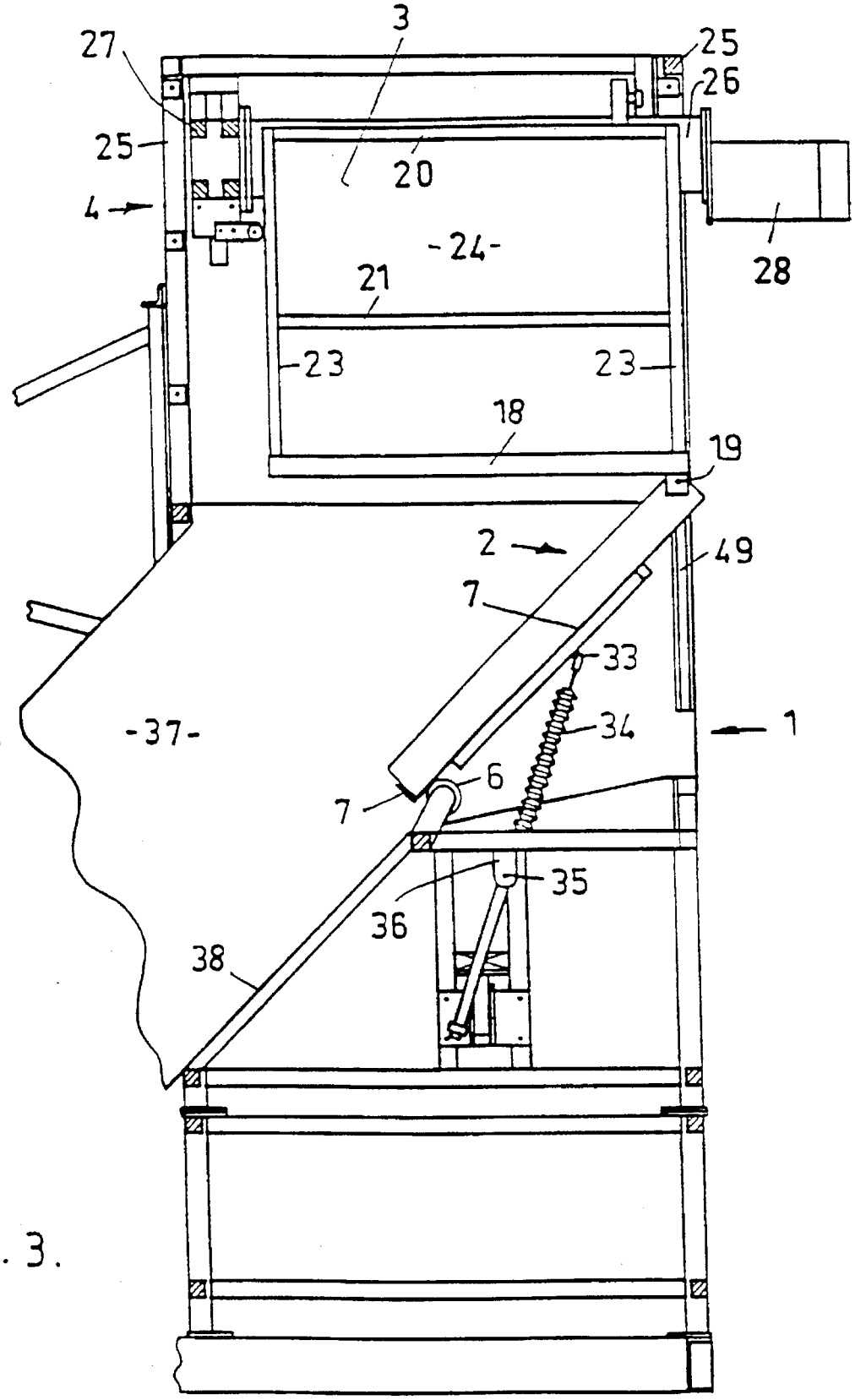
FIG. 3 is an enlarged sectioned side view of the arrangement of FIG. 1 with a container in the discharge condition.

As can be best seen from FIG. 3, below the cradle 46 the tray 7 is supported by the rollers 6 and is connected at approximately a central position 33 to one end of a piston-in-cylinder assembly 34 and is provided with support wheels (not shown) which are centered on the axis of pivotal connection of the container bottom 2 to the base frame 18, as indicated 19, and are engaged in the tracks 49. The cylinder of assembly 34 is pivotally connected at 35 to a bracket 36 on the frame 4. The tray 7 is disposed between the sides 37 of the chute 8.

In a typical operation, the container 1 would be supported on a fork lift truck and would be presented to the cradle 46 and would be guided thereinto by the guides 28 until the leading side 3 of the container abuts a stop at the base of the cradle. The container would be lowered to engage the container bottom 2 with the tray 7 (see FIG. 1) which is held firmly against the underface of the bottom 2 by the assembly 34 at all times and the cradle would be moved to position the "U" legs 26 to allow the shafts 29 when part rotated to engage the lugs thereof under the top rails 20 of opposed sides 3 of the container 1.

The container bottom 2 would then be released from the enclosure comprised of the sides 3 and the container 1 would be raised by the cradle 46 as it is elevated by the assemblies 32. As this occurs the tray 7 will be held against the bottom 2 by the assembly 34 and the tray 7 will be supported by the rollers 6. The engagement of the tray wheels in the tracks 49 allow the tray 7 to move with the bottom 2, both pivotally and linearly, until the bottom and the tray assume the position shown in FIG. 3.

The sultanas from the container will gravitationally discharge from the enclosure comprised of the sides 3 onto the chute bottom 38 and progress down the chute 8 until progress is blocked by the stationary breaking means 9. The breaking means 9 comprises a grille of bars 15 some of which are long and are indicated **15*a* and are widely spaced and shorted bars indicated 15*b* positioned between the bars 15*a* at their lower ends. In this way the spacing of the bars 15** is greater in the top zone of the grille than in the lower zone, this facilitates the reduction of the mass of sultanas into differed sized smaller masses.

The grille 9 is mounted in rails 39 and is able to be raised an lowered to vary the position of the lower ends of the bars 15 relative to the chute bottom 38 by means of piston-in-cylinder assemblies 40. It is to be noted that the ends of the bars are pointed as indicated 50.

The ability to move the grill 9 is provided to accommodate the unusual, but occasionally occurring, problem that a mass of sultanas will not break on the bars 15 and will remain resting against the upstream sides of the bars 15. If this occurs the grille can be raised to allow the slats 11 on the conveyor belt 10 direct access to the sultana mass. In the unlikely event the mass still cannot be broken up the grille can then be lowered with the descending pointed ends 50 of the bars 15 forceably breaking up the mass of sultanas.

The conveyor belt 10 of the moving breaking means passes around a bottom roller 41 and a top roller 42 and the tops of the slats 11 pass in very close proximity to the terminal end of the chute bottom 38. In order to accommodate sultanas which pass beyond the terminal end of the chute bottom 38 into the spacings between the slats 11 below the level of the chute bottom 38 the tops of the slats 11 pass in very close proximity to the surface of a sealing plate member 43, which has a length exceeding the spacing between consecutive slats. It follows that any sultanas which do escape over the end of the chute bottom 38 and fall will be trapped between the conveyor belt 10, the surface of the plate 43 and the advancing slat 11 and will be conveyed upwardly away from the chute in a normal manner. The ends of the slats 11 lie closely adjacent side walls 48 of the conveyor thereby to preventing escape of sultanas from the edges of the conveyor belt.

The hopper 12 and the deflector 13 do not form part of the invention. However, it has been found that by the simple device of providing a a deflector 13 which slopes in the direction of the arrow in FIG. 1, that is downwardly and outwardly from the page containing FIG. 1 towards the viewer of FIG. 1, it is possible to obtain an acceptable distribution of the sultanas over the surface of the conveyor 14. The impact following the fall of the sultanas from the end of the conveyor onto the deflector 13 ensures and very small clumps of sultanas (say two or three which may still be adhered together) are broken into single berries.

The foregoing detailed description is of a presently preferred arrangement for achieving the objects of the invention. The specific construction described can be varied without departing from the inventive concepts which are defined in the following claims.

I claim:

1. A method of converting a primary product mass comprised of normally discrete elements which superficially surface adhere to each other when bulk stored to individual elements, said method including the steps of gravitationally delivering the primary product mass to a stationary breaking means in the form of an apertured area to randomly disassociate the adhered elements comprising said primary mass and thereby produce individual elements and secondary masses of the elements of a size able to pass through said apertures, discharging the individual elements and the secondary masses from said stationary breaking means onto an adjacent moving breaking means which includes a conveying belt fitted with transverse slats, collecting discharged individual elements on said slats and conveying them to a conveyor discharge location, supporting the discharged secondary masses on the moving breaking means and repeatedly impacting the second masses with said conveyor slats to reduce said secondary masses to individual elements to be conveyed by the conveyor slats to the conveyor discharge location.

2. The method as claimed 1 including the preliminary steps of bulk storing the elements in a container with an opening bottom and bottom discharging the container contents as a primary product mass onto a chute which will gravitationally direct the discharged product mass against the stationary breaking means.

3. An apparatus to carry out a method of converting a primary product mass comprised of normally discrete elements which superficially surface adhere to each other when bulk stored to individual elements, where the method includes the steps of gravitationally directing the primary product masses against a stationary breaking means in the form of an apertured area to randomly disassociate the elements of the primary mass into individual elements and secondary masses of the elements of a size able to pass through said apertures, followed by a discharge of the individual elements and the secondary masses from said stationary breaking means onto an adjacent moving breaking means which includes a conveying belt fitted with transverse slats to convey discharged individual elements to a conveyor discharge location, the remaining secondary masses are repeatedly impacted by the conveyor slats to reduce the secondary masses to individual elements to be conveyed by the conveyor slats to the conveyor discharge location.

4. Apparatus as claimed in claim 3 wherein the stationary breaking means comprises a grille including a plurality of spaced apart bars with the spacing between the bars constituting said apertures.

5. Apparatus as claimed in claim 4 wherein the bars in the grille are parallel and are arranged in zones with the bars of a first zone adjacent the bottom of the chute more closely spaced than the bars in a second zone spaced from the bottom of the chute.

6. Apparatus as claimed in claim 4 wherein the grille has a bottom edge which lies adjacent the bottom of the chute and the grille is movable in a plane generally transverse to the direction of travel of the primary product mass along the chute to allow variation in the distance between the end of the grille and the bottom of the chute.

7. Apparatus as claimed in claim 3 wherein the moving breaking means is a belt conveyor with a portion of its path of travel in a plane which lies substantially parallel to a plane occupied by said grille, said strikers are transverse slats on the belt, said chute bottom at the discharge end of the chute lies closely adjacent the upward path of travel of top edges of said slats and the top edges of the slats immediately prior to passing the chute bottom at the discharge end of the chute are in substantially rubbing engagement with a sealing surface thereby preventing downward escape of elements from said moving breaking means.

8. Apparatus as claimed in claim 3 in combination with a container support for use with a container having an opening bottom, said support including a container cradle adapted to releaseably couple to the container, a cradle raising and lowering means, a container bottom support means to maintain the container bottom in an operative relationship with said chute as the container cradle and the container supported thereby is elevated to said chute.

* * * * *